United States Patent [19]

Shimizu

[11] 4,376,995

[45] Mar. 15, 1983

[54] TIMEKEEPING DEVICE

[75] Inventor: Eisaku Shimizu, Suwa, Japan

[73] Assignee: Kabushiki Kaisha Suwa Seikosha, Tokyo, Japan

[21] Appl. No.: 147,435

[22] Filed: May 7, 1980

[30] Foreign Application Priority Data

May 8, 1979 [JP] Japan ..... 54-56020

[51] Int. Cl.[3] ..... G04F 8/00; G04C 15/00; G04C 9/00

[52] U.S. Cl. ..... 368/107; 368/155; 368/187

[58] Field of Search ..... 368/3, 10, 12, 62, 46, 368/61, 107–113, 155, 184, 185, 187, 200–202; 364/569, 705, 709, 710, 704; 340/309.1, 309.4; 235/92 T

[56] References Cited

U.S. PATENT DOCUMENTS

| | | | |
|---|---|---|---|
| 3,462,741 | 8/1969 | Bush et al. | 364/704 |
| 4,035,627 | 7/1977 | Dickinson et al. | 368/10 X |
| 4,115,870 | 9/1978 | Lowell | 364/709 |
| 4,151,596 | 4/1979 | Howells | 364/705 |
| 4,218,876 | 8/1980 | Hashimoto et al. | 368/10 |
| 4,238,832 | 12/1980 | Tsuzuki et al. | 364/705 |
| 4,245,323 | 1/1981 | Yamazaki et al. | 368/10 X |
| 4,247,925 | 1/1981 | Mesai et al. | 368/3 |
| 4,270,193 | 5/1981 | Igakiawa | 368/47 |

*Primary Examiner*—Vit W. Miska

*Attorney, Agent, or Firm*—Blum Kaplan, Friedman, Silberman & Beran

[57] ABSTRACT

An electronic timekeeping device performs timekeeping functions and on command selectively outputs a plurality of data signals and performs supplemental functions for an external unit such as a microcomputer. Control signals inputted via a data bus from the external unit actuate switch means which selectively permit the external unit to command the timekeeping device to output required data signals or perform a particular function. The basic timekeeping circuits of the device continuously perform the timekeeping function regardless of the data signals or functions which have been commanded for output, and when the external unit is inoperative. Data signals from the external unit can also be input to modify the data output of the timekeeping device. Individual data buses within the timekeeping device are devoted to particular functions.

20 Claims, 5 Drawing Figures

FIG. 1
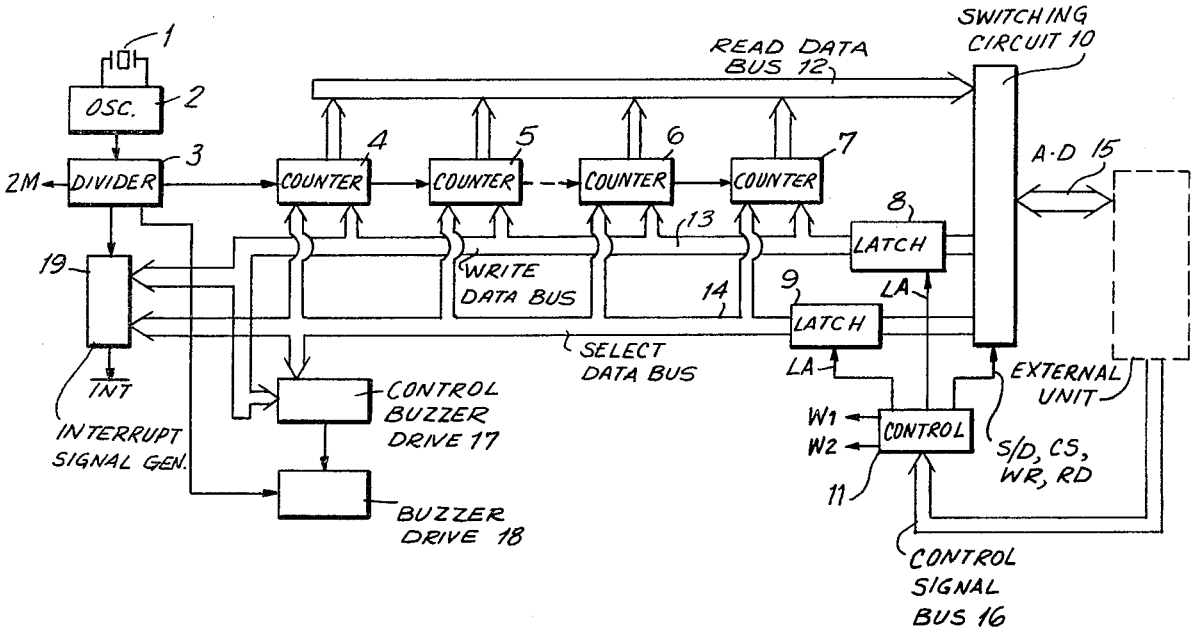
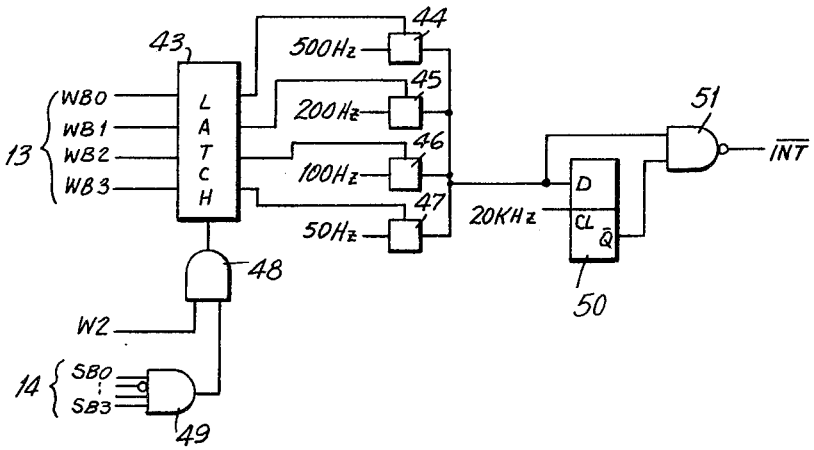
FIG. 3

TIMEKEEPING DEVICE

BACKGROUND OF THE INVENTION

This invention relates generally to a timekeeping device operating from an internal oscillator circuit and more particularly to a timekeeping device having supplemental functions which can be accessed by an external unit for the performance of particular functions or the output of particular timing signals. The use of a microcomputer or microprocessor in systems having stored programs and data is rapidly expanding. Such systems make it possible to change specifications and requirements and to effect the processing of a plurality of different functions. If a timekeeping function is performed by the microcomputer itself, this apparatus is not so suitable for accomplishing multiple functions because while timekeeping, the microcomputer can perform no other operation. Therefore, it becomes necessary to resort to a timer system. In another operational system, accurate and periodic clock signals are imput in an interrupting mode so that the system is subjected to a timekeeping process during each interruption. However, according to this system the computer's central processing unit is continuously devoted to a duty cycle as a result of timekeeping processing. An interruption in the time measurements takes place during any real time processing so that the real time controlling operation becomes inaccurate. Another, and greater deficiency in present systems is that the microcomputer, because of its relatively high power consumption in operation, is likely to have its main switch turned on and off and to be rendered conductive and non-conductive while it is being transported. In the process, stored time information volatilizes and is lost. For this reason, an electronic timekeeping function desirably operates independently on a battery at reduced power and voltage so that it operates for extended periods of time even when a battery having a small capacity is used. In this way independent timekeeping accuracy is preserved.

What is needed is a timekeeping device for operation in cooperation with external units, such as a microcomputer or microprocessor, the timekeeping device maintaining its accuracy and providing a simple interface with the external unit.

SUMMARY OF THE INVENTION

Generally speaking, in accordance with the invention, a timekeeping device especially suitable for cooperation with an external unit such as a microcomputer or microprocessor is provided. The electronic timekeeping device performs timekeeping functions and selectively outputs a plurality of data signals and performs supplemental functions for an external unit such as a microcomputer. Control signals inputted via a data bus from the external unit actuate switch means which selectively permit the external unit to command the timekeeping device to output particular data signals or perform a particular function. The basic timekeeping circuits of the device continuously perform the timekeeping functions regardless of the data signals or function which have been commanded for output, and when the external unit is inoperative. Data signals from the external unit can also be input to modify the data output of the timekeeping device. Individual data buses within the timekeeping device are devoted to addressing, readout and writing-in of selected portions of the timekeeping device. Latch circuits store data from the external unit and maintain selected conditions on the data buses, and a two-way bus interconnects the timekeeping device and external unit. Interrupt and buzzer signals are provided.

Accordingly, it is an object of this invention to provide an improved timekeeping device which freely communicates timekeeping information to the outside, that is, to external units, such that a series of timing functions, e.g., a conventional timepiece, stopwatch, timer, and alarm, can be effected in combination with an external device such as a microcomputer.

Another object of this invention is to provide an improved timekeeping device for generating externally outputted signals for use in an external unit such as a microcomputer or warning system such that the load upon the external unit is lightened and the number of peripheral devices associated with the external unit may be reduced.

A further object of this invention is to provide an improved timekeeping device which is able to communicate with an external unit and perform supplemental functions commanded by the external unit in a manner similar to the commands for an output of time information.

Still another object of this invention is to provide an improved timekeeping device which is formed on a single integrated circuit chip having low power consumption components such as C-MOS transistors such that timekeeping for extended periods may be continuously performed even when the associated external unit, such as a microcomputer, is disconnected from its main power source.

Yet another object of this invention is to provide an improved timekeeping device having provision for simple inputting and outputting of data between the timekeeping device and an external unit, accomplishing these objects through data buses or the like in a manner similar to the access to typical input-output devices and a memory unit.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a functional block diagram of a timekeeping device in accordance with this invention;

FIG. 3 is the circuit of an interrupt signal generating circuit in the timekeeping device of FIG. 1;

DESCRIPTION OF THE PREFERRED EMBODIMENTS

Figure 2:
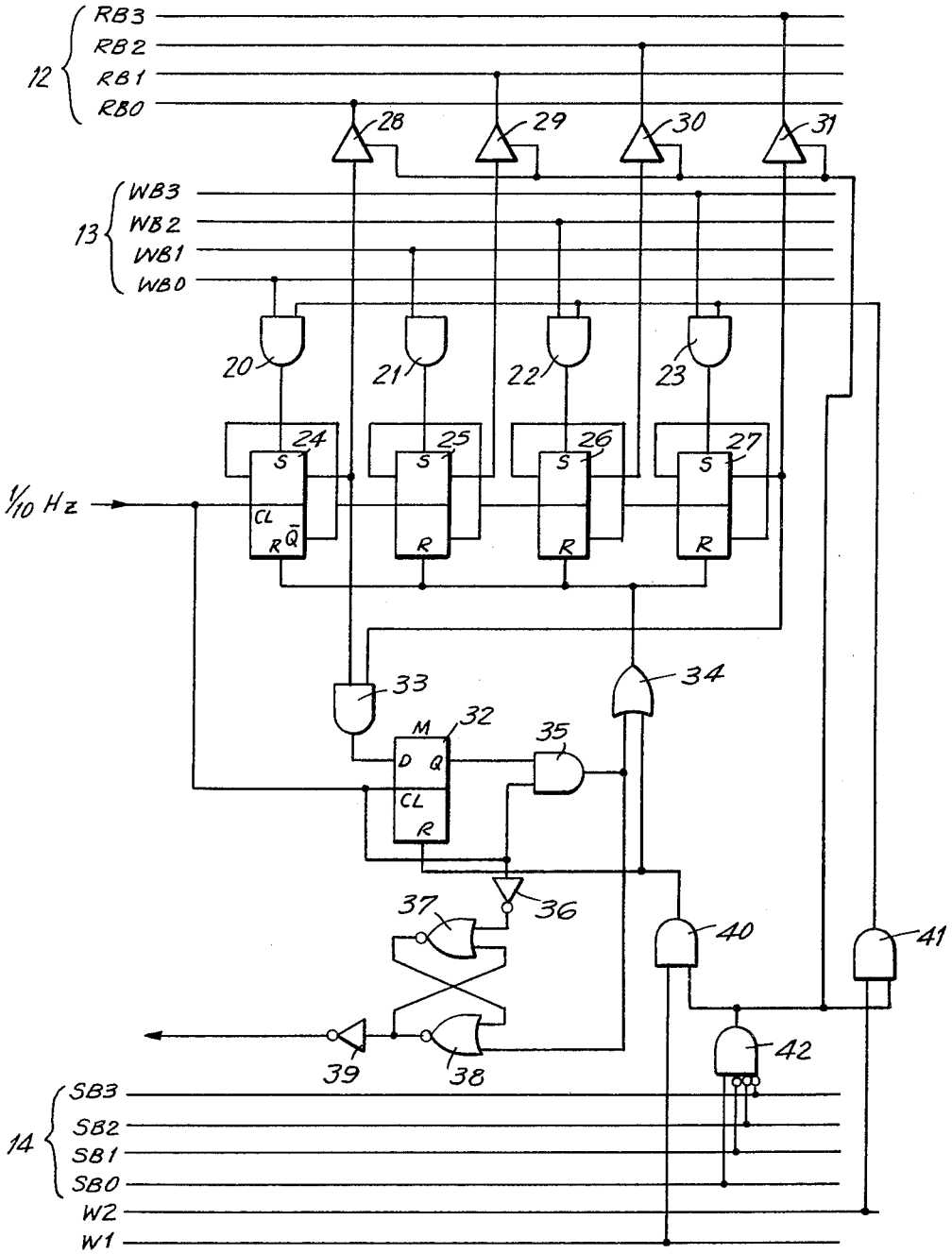
FIG. 2 is a circuit of a counter of the timekeeping device of FIG. 1.

With reference to FIG. 1, the timekeeping device in accordance with this invention includes: a quartz crystal vibrator 1, vibrating at a rate of 4.0 MHZ; an oscillator circuit 2 associated with the vibrator 1; a divider network 3; counter circuits 4–7; a write data bus 13; a latch circuit 8 for the write data bus 13; a select data bus 14; and a latch circuit 9 associated with the select data bus 14. Also included in the timekeeping device are a switching circuit 10 for switching address information and data information, a control circuit 11 for controlling the switching functions of the switching circuit 10, a read data bus 12, and a two-way address data bus 15 through which communication of data between the timekeeping device and an external unit, such as a microcomputer or microprocessor is effected. Further, the timekeeping device of this invention includes a buzzer drive controlling circuit 17, a buzzer driving circuit 18, and an interrupt signal generating circuit 19. Operation of the timekeeping device is explained more fully hereinafter.

It should be noted that between the counters 5–6, a broken line indicates that more counter stages have been omitted from the drawing since their relationship in the functional block diagram is the same as for the other counters 4–7 already shown. As seen in FIG. 2, the counters of FIG. 1 each represent a plurality of flip-flop stages and each counter is constructed to receive or output a plurality of binary coded decimal bits, for example, Four bits as illustrated.

The select data bus 14 has access to every counter stage 4–7 and also to the interrupt signal generator 19 and buzzer drive controlling circuit 17. The write data bus 13 connects to the same functional blocks in FIG. 1 as does the address data bus 14. The read data bus 12 is connected to every counter stage 4–7, and the address data bus 15 communicating with the external unit (broken lines) is able to communicate with each data bus 12, 13, 14 through the switching circuit 10. The divider network 3 provides frequency signals to the counter stage 4 which in turn outputs lower frequency signals to counter stage 5, and so forth in a conventional manner. The divider network 3 also outputs frequency signals to the interrupt signal generator 19 and to the buzzer drive 18. The switch control circuit 11 receives signals from the external unit as does the switching circuit 10. A data bus 16 carries the signals to the control circuit 11. As stated above, the counters 4–7 operate on a binary coded decimal system for seconds, minutes, days but it should be understood that counters which output signals representative of hours and months operate on a duodecimal system of 1 to 12.

Each functional element of the diagram of FIG. 1 which can be controlled by the external unit has an address comprised of binary bits. For illustration of a timekeeping device in accordance with this invention, a four bit address will be described. The select data bus 14 has four lines devoted to the addresses, mainly $SB_0$ to $SB_3$. In Table 1 are listed the addresses for the individual counter stages having output signals with periods of 1/100 seconds, 1/10 seconds, 1 second, 10 seconds, 1 minute, 10 minutes, 1 hour, 1 day, 10 days, 1 month, 1 year, 10 years. There are also address codes devoted to the interrupt signal generator 19 and the buzzer control and drive 17, 18.

Each functional element connected to the select or address data bus 14 has a built in decoder which operates to decode the data bits presented on the select data bus 14. Only the addressed function is enabled or activated by the data on the select data bus 14. The other functional circuits do not "recognize" or respond to an address which does not correspond to the particularly assigned address (Table 1) of that function. Through the switching circuit 10, the address data bus 15 selectively carries the addresses of the units described above, and also carries time data, interrupt data and buzzer data as inputs. The bus 15 also carries outputs from the read data bus 12 as described hereinafter. Because both address and data signals are communicated through a common bus 15, the number of pins and connections in the circuits is reduced so as to result in a significant cost advantage in manufacture.

The latches 8, 9, and the data buses 13, 14 respectively hold signals delivered from the external unit through the address data bus 15 and switching circuit 10 such that more than four data bits are effectively operative simultaneously in the timekeeping device although only four bits are delivered by a data bus at one time. Thus, the external unit may address a particular function in the timekeeping device and then with the signal held in the latch 9, the external unit can command with new signals the write-in or read-out of data for the counters 4–7, or command the performance of a function such as interrupt 19 or buzzer 17, 18.

Figure 5:
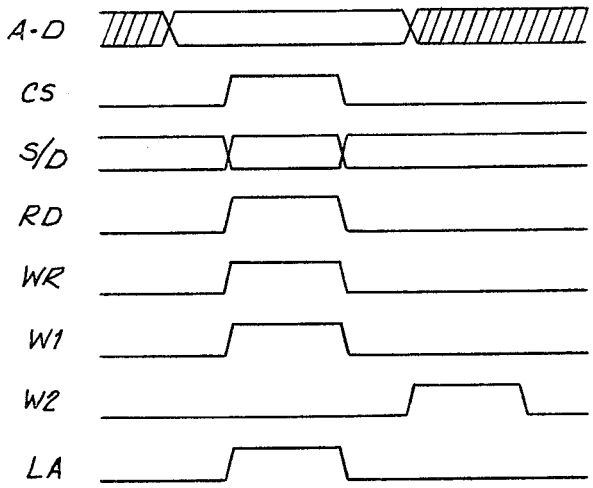
FIG. 5 are signal waveforms associated with the block diagram and circuits of FIGS. 1–4.

As shown in FIG. 1 and indicated with reference to FIG. 5, the control circuit 11 receives signals from data bus 16 and regulates the condition of the switching circuit 10 such that communication is established between the external unit via the data bus 15 and one of the three data buses 12, 13, 14 in the timekeeping device. The control circuit 11 also provides signals LA for latching the data from the address data bus 15 in the select data bus 14 and write bus 13 as required.

Addressing is effected when the switch control signal S/D is at a high level and data selection (write-in) is effected when the switching control signal S/D is at a low level. The buzzer drive controlling circuit 17 and the interrupt signal generating circuit 19 have their output signals modified by the external device as explained hereinafter. In combination with the external device these circuits comprise a signal forming means. A signal of 2 MHZ, fed from the frequency divider network 3, is used as a clock signal for the external device.

FIG. 2, as an example, shows the counter 5 of FIG. 1 which outputs signals having a 1/10 second period. The counter 5 includes four flip flops 24–27 and thus a four bit code from 0000 to 0101 (0 to 10 decimal) can be formed by the simultaneous parallel output of the flip flops 24–27. The flip flop 24 is clocked every 1/10 second and its output Q is changed in the conventional manner while its output $\overline{Q}$ is fed as a clock signal to the subsequent flip flop stage 25 and so on conventionally. When the outputs Q of flip flop stages 24 and 27 are both high, which first occurs at the ninth pulse, both inputs to an AND gate 33 are high. As a result a flip flop 32 has a high signal applied at its D input. This high D input signal is clocked by the 1/10 hertz signal whereby the AND gate 35 goes high with its output driving the OR gate 34. The output of the OR gate 34 goes high and resets the flip flops 24–27 so that their outputs are 0000. Thus, it can be seen that the outputs of the flip-flops 24–27 go from 0 to 9, here expressed decimally although the outputs are actually in BCD format, and then goes back to 0. This is a continuous process. A set-reset circuit comprised of inverters 36, 39 and NOR gates 37, 38 is set by the incoming 1/10 hertz signals from the divider network 3 (FIG. 1) but is reset on every tenth pulse when the output of AND gate 35 goes high. This high signal is input to the NOR gate 38. Accordingly, the inverter 39 outputs one pulse every second which goes to the next counter stage of FIG. 1 where pulses of one second are accumulated. In summary, the BCD output signals at the Q terminals in parallel of flip-flops 24–27, count from 0 to 9 (decimal equivalent) continuously at 1/10 second intervals of change in output.

When a counter 4–7 of FIG. 1 is to be corrected in its output, the address data for the counter which is to be corrected is selected by the external unit and fed through the address data bus 15 to the timekeeping device of this invention. Again using the 1/10 second counter of FIG. 2 as an example, the address code 0001 (1/10 seconds, Table 1) is fed through the address data bus 15. At the same time, signals from bus 16 are fed to the control circuit 11 with the signal S/D in a high state which connects the switching circuit 10 to the select data bus 14. Also, the function select signal CS and write signal WR are set at high levels (FIG. 5). As a result of the signals 16 delivered to the control 11, a latch signal LA goes high and strobes the address data from the address data bus 15, passing through the switching circuit 10, into the latch circuit 9 which then holds the aforementioned code 0001. Thus the output signals (0001) from the latch 9 appear and are retained on the select data bus 14 which connects to every addressable element of the timekeeping device (FIG. 1). However, only the 1/10 second counter of FIG. 2 is able to respond to the signal 0001 on the address lines $SB_3$, $SB_2$, $SB_1$, $SB_0$ respectively. With this address signal (0001) on the lines of the select data bus 14, a decoder gate 42 in the counter 5 having four inputs, of which three are inverted, goes high at its output. No other function of FIG. 1 has such a decoder gate configuration cooperating with the select data bus 14.

When the output of gate 42 goes high, output buffers 28–31 connected to the Q outputs of the flip-flops 24–27, respectively, are turned on so that the contents, that is, the time data, of the flip-flop stages 24–27 of the counter 5 are fed to the switching circuit 10 through the read data bus 12 comprised of the lines RB0–RB3. Thereby, when the read signal RD and the function select signal CS are high as described above, the time data from the counter 5 can be commanded to the outside of the timekeeping device of this invention through the address data bus 15 where it may be used by an external unit.

The technique for reading out the data being generated in a counter stage of the timekeeping device has been described. When a counter (FIG. 1) is to be corrected, the data for correction is fed through the address data bus 15 to the one addressed function and the switching control signal S/D is given a low level whereas the function select signal C/S and the write signal are at high levels. The correcting data, e.g. 0010, are fed from the external unit to the address unit bus 15 and these signals pass through the switching circuit 10 and are held in the latch 8 in a manner similar to latching of the latch 9. Accordingly, the bits of the correcting data 0010 are present on the lines WB0–WB3 of the write data bus 13. Then a signal W1 from the control circuit 11 goes high in response to an input signal from bus 16 from the external unit. The high signal W1 causes the output of AND gate 40 to go high. This output of gate 40 is only possible in the addressed function where the decoder gate 42 (FIG. 2) has a high output. The high output from AND gate 40 drives the OR gate 34 which goes high at its output and resets all of the flip-flops 24–27.

The outputs of AND gates 20–23 are fed to the set S inputs of the flip-flops 24–27. After the reset signal W1 falls, a signal W2 from the control circuit 11 goes high. Because the output of gate 42 is high, the AND gate 41 goes high and clocks the contents of the write data bus 13 into the flip-flop stages 24–27 through the AND gates 20–23. As a result, the instantaneous content of the 1/10 second counter stages 24–27 is 0010, i.e., the correcting data.

Thus it can be seen that correction and reading of any counter stage can be easily and quickly effected by signals coming from an external unit.

A circuit diagram for the interrupt signal generating signal 19 of FIG. 1 is shown in FIG. 3. As seen in Table 1, the interrupt circuit 19 has the address 1101 (INT). When this address is applied to the select data bus 14 through the address data bus 15, switching circuit 10 and latch 9, the output of a decoding AND gate 49 goes high. The inputs $SB_0$ to $SB_3$ to gate 49 are the lines of the select data bus 14 as described above. The address data from the bus 15 is retained in the latch circuit 9 such that the decoder gate 49 is held open. Simultaneously, with the inputting of the address data 1101 which selects the interrupt circuit, the control 11 is inputted the signals S/D, CS and WR so that data from the address data bus 15 is fed to a latch circuit 43 through the lines WB0–WB3 of the write data bus 13. On the subsequent occurrence of the signal W2 (FIG. 5) from the external unit by way of the control 11, the data from the write data bus 13 is clocked into the latch circuit 43 by a signal generated at the output of the AND gate 48. The output of the AND gate 48 goes high on the occurrence of the signal W2, only because this interrupt circuit has been addressed and the address has been recognized by the decoder gate 49.

The data which is fed to the latch 43 by way of the write data bus 13 is in four bit format, and in the illustrated example of FIG. 3 the latch has four outputs. Therefore, a selection may be made between the four output signals. The outputs of the latch 44 are individually fed to one of four transmission gates 44–47, and each transmission gate has a different frequency signal inputted from the divider network 3. As illustrated 50, 100, 200 and 500 hertz signals are inputted to the transmission gates 44–47. For example, the code 0001 applied to the latch 43 opens the transmission gate 44 and provides an output of 500 hertz. A code 0010 provides 200 hertz; a code 0100 provides 100 hertz and a code 1000 provides 50 hertz output from the transmission gates 45–47 respectively. Thus, in the example, the code 0010 fed on the data bus 13 to the addressed interrupt circuit 19 selects transmission gate 45 and a 200 hertz signal is outputted as an interrupt signal from the transmission gate 45.

The 200 hertz signal is differentiated in a differentiating circuit comprised of a flip-flop 50 and a NAND gate 51. The flip-flop 50 is clocked by a 20 KHZ signal from the divider network 3 (FIG. 1). The width of the differentiated signal outputted from the NAND gate 51 is such that the interrupt signal (INT) terminates while an interruption is being effected in the external unit. Different frequencies of interrupt signals as required by the external unit can be selected by changing the software of the external unit to provide different inputs for the write data bus 13. In the illustrated embodiment with four lines in the data buses, four parallel bits are available and accordingly sixteen kinds of interrupt signals INT can be selected as a maximum number. Also the pulse width of the signals from the differentiator circuit 50, 51 can be varied. The interrupt signals fed from the interrupt generating circuit 19 can have various applications depending on the nature of the external unit. For example, interrupt signals can serve as standard signals or key scan signals for a timer of an external unit.

Figure 4:
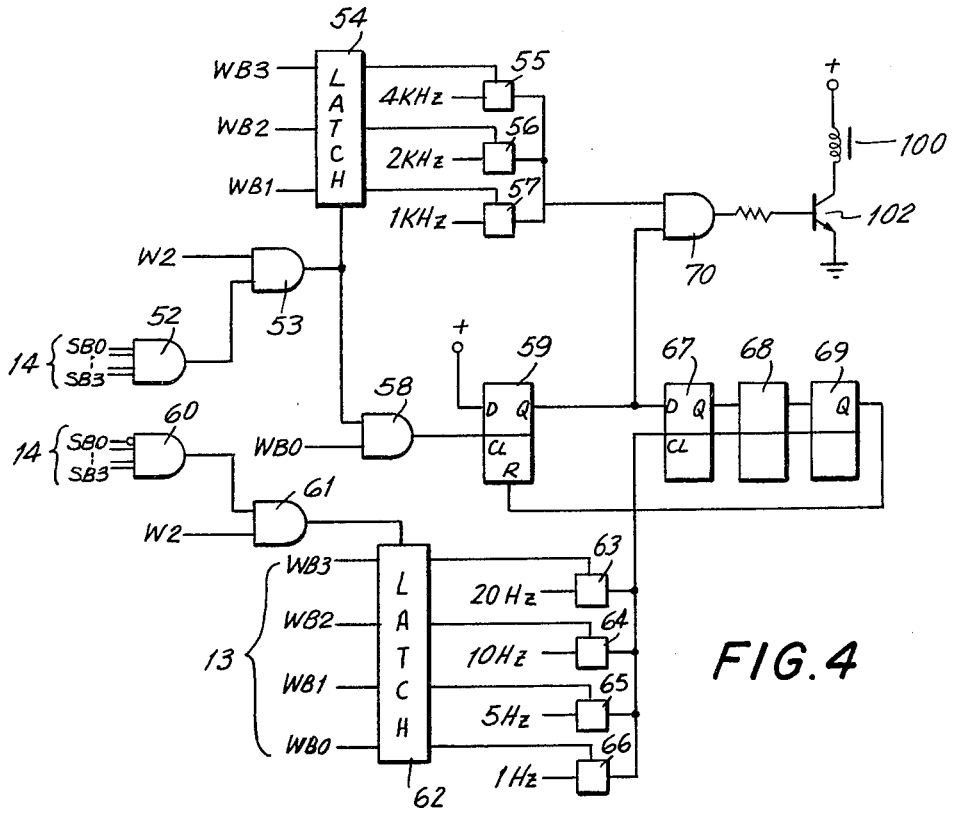
FIG. 4 is a buzzer drive controlling circuit and buzzer driving circuit of the timekeeping device of FIG. 1.

FIG. 4 is a diagram of the buzzer drive controlling circuit 17 and the buzzer drive circuit 18 of FIG. 1. When the address data 1111 (BUZ 2) (Table 1) is applied through the address data bus 15, switching circuit 10, latch 9, and select data bus 14 on the lines SB0–SB 3, as described above, a decoder gate 52 goes high at its output and provides a signal to an AND gate 53. Gate 52 remains high because of the latching of the address data by the latch 19. Then, on the occurrence of the signal W2 from the control circuit 11, the AND gate 53 goes high at its output and clocks the information on lines WB1–3 of the write data bus 13 into a latch 54. The data held in the the latch 54 is applied to the control element of the transmission gates 55–57. As an example, these transmission gates 55–57 are adapted such that transmission gate 57 is conductive for the code 001X on the write data bus 13, that is, when the second bit is high. The transmission gate 56 is conductive for the code 010X, that is, when the third bit is high, and the transmission gate 55 is conductive with a code 100X, that is, when the fourth bit is high. Each transmission gate 55–57 has a different frequency signal from the divider network 3 (FIG. 1) applied to its input.

Therefore, depending upon which transmission gate 55–57 is triggered by the coded signal from the latch 54, a different frequency output from the transmission gate network 55–57 is available.

In other words, a different drive frequency or tone is available from each transmission gate 55–57. This tone signal is applied to one input of an AND gate 70 having its output connected through a resistor to the base of a transistor 102. The emitter/collector of the transistor 102 are connected in series with an electro-accoustical device 100, for example, a loud speaker coil, across a source of DC voltage. When the other input to the AND gate 70 is high, a tone signal from the transmission gate network 55–57 passes through the AND gate 70 and turns the transistor 102 on and off at the frequency of the selected signal from the transmission gates 55–57. When the transistor 102 is on, a current flows from the DC source through the electro-accoustical device 100 and an audible buzzer sound is produced.

The sigal which opens the AND gate 70 to initiate the buzzer sound is produced as follows. An AND gate 58 has the output of AND gate 53 for one input. The other input to the AND gate 58 is the line WB0 which is part of the write data bus 13. When the first bit on the write data bus 13 is high, that is, the code is XXX1, the gate 58 goes high. Then, the output of gate 58 is input as a clock signal to a flip flop circuit 59. The D input of the flip flop 59 is connected to a high potential and the clock signal from the gate 58 transmits this high signal through the flip flop 59 and applies a high signal to the D input of a register stage 67. The Q output of the flip flop 59 is also applied to the AND gate 70. Thus (FIG. 4) when a four bit signal is applied to the write data bus 13 and the first bit on the data bus is high, the electro-accoustical device 100 will sound with a tone determined by the second, third and fourth data bits on the write data bus 13. When the first bit (WB0) on the write data bus 13 is low, then the AND gate 58 does not transmit a high output and the output of the flip flop 59 remains low such that the AND gate 70 does not open and there is no buzzer signal.

Once clocked, the flip flop 59 output Q remains high until it is reset by a signal applied to the reset terminal R. The latch 54 continues to hold the tone selecting bits. Then the 1110 address select signal is applied to the select data bus 14 by way of the latch 9, switching circuit 10 and address data bus 15. This signal opens, that is, makes high at the output, the decoder gate 60. The output of gate 60 is inputted to an AND gate 61 which goes high at its output when the signal W2 from the control 11 is applied to the other input. Substantially simultaneously with the application of the address for gate 60, another coded signal is applied to the write data bus 13 (WB0–WB3) and this signal is applied at the inputs to a latch 62. When the AND gate 61 goes high, the data from the write data bus 13 is pulsed into the latch 62 and retained. The latch circuit 62 has its output terminals connected directly with the control elements of transmission gates 63–66. These gates 63–66 are connected such that the transmission gate 63 is conductive for the code 0001, that is when the first bit of the write data bus signal is high. The transmission gate 64 is conductive for the code 0010, that is, when the second bit is high, and the transmission gate 65 is conductive for the code 0100, that is when the third bit is high. The transmission gate 66 is conductive for the code 1000, that is when the fourth data bit is high. Each transmission gate 63–66 has a different frequency signal applied to its input from the divider network 3 (FIG. 1). Accordingly, for the presented example, signals of 1, 5, 10 and 20 hertz are available from the transmission gate network 63–66. The output of a selected transmission gate 63–66 is used as a clock signal for the shift register 67–69. The Q output terminal of the last stage 69 of the shift register 67–69 is fed back to the reset terminal R of the flip flop 59. Accordingly the electro-accoustical device 100 will sound its buzzer signal until the output of the register stage 69 goes high. The number of cycles of signal from the selected transmission gate 63–66 for resetting the flip flop 59 remains constant, however, the duration of the buzzer's sound depends on the period of the frequency signal which is transmitted by the selected one of the gates 63–66.

Thus, in summarizing, when the select data bus 14 carries the address signal 1111 (BUZ 2), the buzzer is turned on if the first bit of data on the write data bus 13 is high and when the signal w2 occurs. Then, when the address select data bus 14 carries the code 1110 (BUZ 1), the duration of the buzzer sound is determined.

FIG. 5 shows timing wave forms of signals from the control circuit 11, and from the address data bus 15. The signal S/D, which is applied from the bus 15, determines whether data is to be read out or imputted on the read or write data bus 12, 13 respectively or whether an address signal is to be applied through the select data bus 14. Signals CS, S/D, RD and WR are applied through bus 16 to control circuit 11 which directs them in proper sequence to the switching circuit 10. RD is a signal for read out on the read data bus 12. The signal LA pulses data into the latches 8, 9 and signals W1–W2 are for purposes as described above.

In summary, the timekeeping device in accordance with this invention can output information to an external unit or receive information from the external unit in a simple manner and thereby effect a timing function for the external unit. Moreover, the timing device in accordance with this invention outputs time signals generated by a source within the timekeeping device so that the load placed upon the external unit is reduced. Further, the external unit can control the output signals from the timekeeping device. The present invention makes a strong combination between timekeeping circuits and the external unit and contributes significantly to the ability of the external unit to perform multiple functions.

The entire circuitry of the timekeeping device including the data buses is formed as an integrated circuit on a single substrate. Thus reliability, small size, simplicity, and reduced manufacturing and assembly costs are achieved.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A timekeeping device comprising:

oscillator circuit means generating a high frequency standard signal;

a divider network dividing down said standard signal and outputting lower frequency signals;

a plurality of functions, said plurality of functions having data input signals and outputs, at least a portion of said functions having inputs derived from said divided down standard signals;

means for individually addressing said plurality of functions by an external unit, said means for addressing including a first data bus interconnecting at least a portion of said plurality of functions;

means for transmitting to said external unit said output signals from said functions, said means for transmitting including a second data bus interconnecting at least a portion of said plurality of functions;

switch means, said switch means being positioned intermediate said external unit and said plurality of functions and being adapted for selectively connecting said first data bus or said second data bus to said external unit, said external unit addressing and reading said functions without time restriction of access nor interruption of said functions, said external unit operating at speeds unlimited by need for access to said function signals.

2. A timekeeping device as claimed in claim 1, and further comprising means for inputting signals from said external unit to at least a portion of said functions, said means for inputting including a third data bus interconnecting at least a portion of said plurality of functions, said switch means being further adapted to selectively connect said portion of functions through said third data bus to said external unit, whereby the condition of said functions are modifiable by data signals from said external unit.

3. A timekeeping device as claimed in claim 2, and further comprising control means, said control means in response to external signals outputting control signals to said switch means, said control signals actuating said switch means to selectively connect said external unit to said data buses.

4. A timekeeping device as claimed in claim 2 or 3, wherein said output signals are transmitted only from an addressed function, and said input signals are applied only to an addressed function.

5. A timekeeping device as claimed in claim 3 and further comprising first and second latch means cooperating with said first and third data buses respectively, said latch means being positioned intermediate said switch means and said plurality of functions, said latch means when pulsed retaining data signals inputted from said external unit through said switch means, whereby said timekeeping device is concurrently actuated by latched data bits on more than one data bus.

6. A timekeeping device as claimed in claim 5, wherein said latch means are pulsed independently by said control means in response to signals from said external unit.

7. A timekeeping device as claimed in claim 6, and further comprising a fourth data bus, said fourth data bus being interposed between said external unit and said switch means, said fourth data bus carrying signals to said switch means for selectively addressing said plurality of functions individually, and for inputting data to an addressed function.

8. A timekeeping device as claimed in claim 7, wherein said fourth data bus transmits data outputted from an addressed function, said outputted data passing through said switch means.

9. A timekeeping device as claimed in claim 2 or 8, wherein a portion of said functions includes counters accumulating in different classes signals from said divider network, whereby timing signals of different periods are outputted on command to said external unit from an addressed one of said counters.

10. A timekeeping device as claimed in claim 9 wherein said counters include stages in series, at least one of said stage being resettable, said control means delivering reset signals from said external unit.

11. A timekeeping device as claimed in claim 10 wherein at least one said stage is settable.

12. A timekeeping device as claimed in claim 11, wherein said at least one settable stage is set by signals delivered from said external unit through said third data bus.

13. A timekeeping device as claimed in claim 2 or 8, wherein one of said plurality of functions includes external signal producing means, said external signal having a frequency and duration determined by input signals from said external unit, said inputted frequency and duration signals being transmitted in part through said third data bus.

14. A timekeeping device as claimed in claim 13, wherein said external signal producing means outputs an audible signal, the frequency of said audible signal being selected from an output of said divider network.

15. A timekeeping device as claimed in claim 2 or 8, wherein one of said plurality of functions includes an interrupt signal generator, said interrupt signal having a frequency determined by input signals from said external unit, said inputted frequency determining signals being transmitted in part through said third data bus, said interrupt signal being an output of said divider network.

16. A timekeeping device as claimed in claim 2 or 8, wherein at least one decoder gate associates with each said function, each said gate being connected to said first data bus, each said gate opening in response to a unique data combination transmitted by said first data bus.

17. A timekeeping device as claimed in claim 7, wherein signals transmitted by said buses are in binary bit format.

18. A timekeeping device adapted for coupling to an external unit for data communications comprising: divider means for dividing a standard signal; a plurality of counters for timing the frequency-divided signal from said frequency dividing means including read and write means for timing information; data buses connected with the read and write means of each of said counters; counter selecting means for selectively connecting said counters with said data buses; data input and output means for connecting said data buses and said counter selecting means with an external unit for data communications said external unit being connected with said counters without time restrictions of access; and signal control means coupled to said input and output means for controlling the content and the output from said counters.

19. A timekeeping device as claimed in claim 18, said timekeeping device being constructed in an integrated circuit having a single substrate.

20. A timekeeping device as claimed in claim 18, wherein said signal control means is adapted for coupling to said external unit for control thereby.

* * * * *